US009435583B2

(12) United States Patent
Dam et al.

(10) Patent No.: US 9,435,583 B2
(45) Date of Patent: Sep. 6, 2016

(54) METHOD AND APPARATUS FOR LIQUEFYING A HYDROCARBON STREAM

(75) Inventors: Willem Dam, The Hague (NL); Ming Teck Kong, The Hague (NL); Leendert Johannes Arie Zoetemeijer, The Hague (NL)

(73) Assignee: Shell Oil Company, Houston, TX (US)

( * ) Notice: Subject to any disclaimer, the term of this patent is extended or adjusted under 35 U.S.C. 154(b) by 2244 days.

(21) Appl. No.: 12/442,042

(22) PCT Filed: Sep. 20, 2007

(86) PCT No.: PCT/EP2007/059960

§ 371 (c)(1),
(2), (4) Date: Jun. 11, 2009

(87) PCT Pub. No.: WO2008/034875

PCT Pub. Date: Mar. 27, 2008

(65) Prior Publication Data

US 2010/0031699 A1 Feb. 11, 2010

(30) Foreign Application Priority Data

Sep. 22, 2006 (EP) ..... 06121110

(51) Int. Cl.
*F25J 3/00* (2006.01)
*F25J 1/00* (2006.01)
*F25J 1/02* (2006.01)

(52) U.S. Cl.
CPC ..... *F25J 1/0057* (2013.01); *F25J 1/0022* (2013.01); *F25J 1/0042* (2013.01); *F25J 1/0052* (2013.01);

(Continued)

(58) Field of Classification Search
CPC ..... F25J 1/0022; F25J 1/0042; F25J 1/0052; F25J 1/0055; F25J 1/0057; F25J 1/0072; F25J 1/0271; F25J 1/0267; F25J 1/0272; F25J 1/0292; F25J 1/0214; F25J 2220/62; F25J 2205/02
USPC ..... 62/606, 611, 613, 618
See application file for complete search history.

(56) References Cited

U.S. PATENT DOCUMENTS 4,404,008 A * 9/1983 Rentler et al. ..... 62/612
4,445,916 A * 5/1984 Newton ..... 62/625

(Continued)

FOREIGN PATENT DOCUMENTS

JP 59081483 A 5/1984
WO 9931448 6/1999

(Continued)

OTHER PUBLICATIONS

Pek J J B et al "Large Capacity LNG Plant Development/Development Des Centrales De Production De LNG De Grande Capacite" International Conference and Exhibition on Liquefied Natural Gas, No. 14th, 2004, pp. PS5-3.1-PS5-3.10, XP009081826.*

*Primary Examiner* — Frantz Jules
*Assistant Examiner* — Webeshet Mengesha

(57) ABSTRACT

A method and apparatus for liquefying a hydrocarbon stream such as natural gas from a feed stream. A feed stream is provided and passed through at least two cooling stages. Each cooling stage involves one or more heat exchangers. One of the heat exchangers involves a first refrigerant circuit having a first refrigerant stream, and a second of the heat exchangers involves a second refrigerant circuit having a second refrigerant stream. The liquefied hydrocarbon stream is expanded and a flash vapor is separated to provide a liquefied hydrocarbon product stream and a gaseous stream. The gaseous stream, at least a part of the first refrigerant stream, and at least a part of the second refrigerant stream are passed through a heat exchanger, for the gaseous stream to provide cooling to the first and second refrigerant streams.

20 Claims, 3 Drawing Sheets

(52) U.S. Cl.
CPC ..... *F25J 1/0055* (2013.01); *F25J 1/0072* (2013.01); *F25J 1/0214* (2013.01); *F25J 1/0267* (2013.01); *F25J 1/0271* (2013.01); *F25J 1/0272* (2013.01); *F25J 1/0292* (2013.01); *F25J 2205/02* (2013.01); *F25J 2220/62* (2013.01)

(56) References Cited

U.S. PATENT DOCUMENTS

| | | | | |
|---|---|---|---|---|
| 4,504,296 | A * | 3/1985 | Newton et al. | 62/612 |
| 4,755,200 | A * | 7/1988 | Liu et al. | 62/612 |
| 5,421,165 | A | 6/1995 | Paradowski et al. | 62/24 |
| 6,272,882 | B1 | 8/2001 | Hodges et al. | 62/613 |
| 6,389,844 | B1 | 5/2002 | Voort | 62/612 |
| 6,449,984 | B1 | 9/2002 | Paradowski | 62/613 |
| 6,742,357 | B1 * | 6/2004 | Roberts | 62/612 |
| 7,127,914 | B2 * | 10/2006 | Roberts et al. | 62/612 |
| 2003/0154739 | A1 | 8/2003 | Fanning | 62/613 |
| 2005/0005635 | A1 * | 1/2005 | Le Metais | 62/612 |
| 2007/0193303 | A1 * | 8/2007 | Hawrysz et al. | 62/612 |

FOREIGN PATENT DOCUMENTS

| | | | |
|---|---|---|---|
| WO | WO2006009646 | 1/2006 | F25J 1/00 |
| WO | 2006087330 A2 | 8/2006 | |
| WO | WO2006087331 | 8/2006 | F25J 1/02 |
| WO | WO2006094969 | 9/2006 | F25J 1/02 |

* cited by examiner

METHOD AND APPARATUS FOR LIQUEFYING A HYDROCARBON STREAM

The present application claims priority from European Patent Application 06121110.8 filed 22 Sep. 2006.

FIELD OF THE INVENTION

The present invention relates to a method and apparatus for liquefying a hydrocarbon stream such as natural gas.

BACKGROUND OF THE INVENTION

Several methods of liquefying a natural gas stream thereby obtaining liquefied natural gas (LNG) are known. It is desirable to liquefy a natural gas stream for a number of reasons. As an example, natural gas can be stored and transported over long distances more readily as a liquid than in gaseous form, because it occupies a smaller volume and does not need to be stored at a high pressure.

The costs in creating and running a liquefying natural gas (LNG) plant or system are naturally high, and much is for the cooling configurations. Thus any reduction in the energy requirements of the plant or system has significant cost benefit. Reducing any cost of any cooling configuration is particularly advantageous.

U.S. Pat. No. 6,272,882 B1 relates to a process of liquefying a gaseous, methane-enriched feed to obtain a liquefied product. The liquefaction process comprises a number of steps, one of which is to separate the partly-condensed refrigerant for the main heat exchanger into a liquid heavy refrigerant fraction and a gaseous light refrigerant fraction. At least part of the liquid refrigerant fraction is cooled, liquefied and sub-cooled against off-gas removed from a flash vessel used after the main heat exchanger. The process of U.S. Pat. No. 6,272,882 B1 shows a single 'train' for liquefaction.

U.S. Pat. No. 6,389,844 B1 relates to a plant for liquefying natural gas. More specifically, it discloses a pre-cooled dual heat exchanger, dual refrigerant system. The plant in U.S. Pat. No. 6,389,844 B1 has a liquefaction capacity that is 40 to 60% higher than that of a single liquefaction train, and comprises one pre-cooling heat exchanger, and at least two main heat exchangers. Each main heat exchanger uses a main refrigerant, which is separated into a heavy liquid fraction and a light gaseous fraction which are only seen to be cooled in the main heat exchanger, prior to expansion.

It is an object of the present invention to improve the efficiency of a liquefying plant or method.

It is a further object of the present invention to reduce the energy requirements of a liquefying plant or method.

It is another object of the present invention to provide an alternative method and apparatus for liquefying a hydrocarbon stream.

SUMMARY OF THE INVENTION

The present invention provides a method of liquefying a hydrocarbon stream, such as a stream of natural gas, from a feed stream, the method at least comprising the steps of:

(a) providing a feed stream;

(b) passing the feed stream through at least two cooling stages to provide a liquefied hydrocarbon stream, each cooling stage involving one or more heat exchangers, one of said heat exchangers involving a first refrigerant circuit having a first refrigerant stream of a first mixed refrigerant, and a second of said heat exchangers involving a second refrigerant circuit having a second refrigerant stream of a second mixed refrigerant;

(c) separating the first refrigerant stream into a first light refrigerant stream and a first heavy refrigerant stream, and separating the second refrigerant into a second light refrigerant stream and a second heavy refrigerant stream;

(d) expanding the liquefied hydrocarbon stream and separating flashed vapour from the liquefied hydrocarbon stream to provide a liquefied hydrocarbon product stream and a gaseous stream; and (e) passing the gaseous stream, the first light refrigerant stream and the second light refrigerant stream through an end heat exchanger, for the gaseous stream to provide cooling to the first and second light refrigerant streams.

In a further aspect, the present invention provides an apparatus for liquefying a hydrocarbon stream, such as a stream of natural gas, from a feed stream, the apparatus at least comprising:

two cooling stages to provide a liquefied hydrocarbon stream from the feed stream, each cooling stage involving one or more heat exchangers, one of said heat exchangers involving a first refrigerant circuit having a first refrigerant stream of first mixed refrigerant, and a second of said heat exchangers involving a second refrigerant circuit having a second refrigerant stream of second mixed refrigerant;

a first separator in the first refrigerant circuit to separate the first mixed refrigerant stream into a first light refrigerant stream and a first heavy refrigerant stream and a second separator in the second refrigerant circuit to separate the second mixed refrigerant stream into a second light refrigerant stream and a second heavy refrigerant stream;

an end-flash system comprising a gas/liquid separator to receive the liquefied hydrocarbon stream and to provide a liquefied hydrocarbon product stream and a gaseous stream; and an end heat exchanger arranged to receive the gaseous stream, the first light refrigerant stream and the second light refrigerant stream, and to allow the gaseous stream to provide cooling to the first and second light refrigerant streams.

BRIEF DESCRIPTION OF THE DRAWINGS

The present invention will now be illustrated in further detail, by way of example only, in accordance with embodiments and with reference to the accompanying non-limiting schematic drawings in which.

DETAILED DESCRIPTION OF THE INVENTION

For the purpose of this description, a single reference number will be assigned to a line as well as a stream carried in that line. Same reference numbers refer to similar components, streams or lines.

Figure 1:
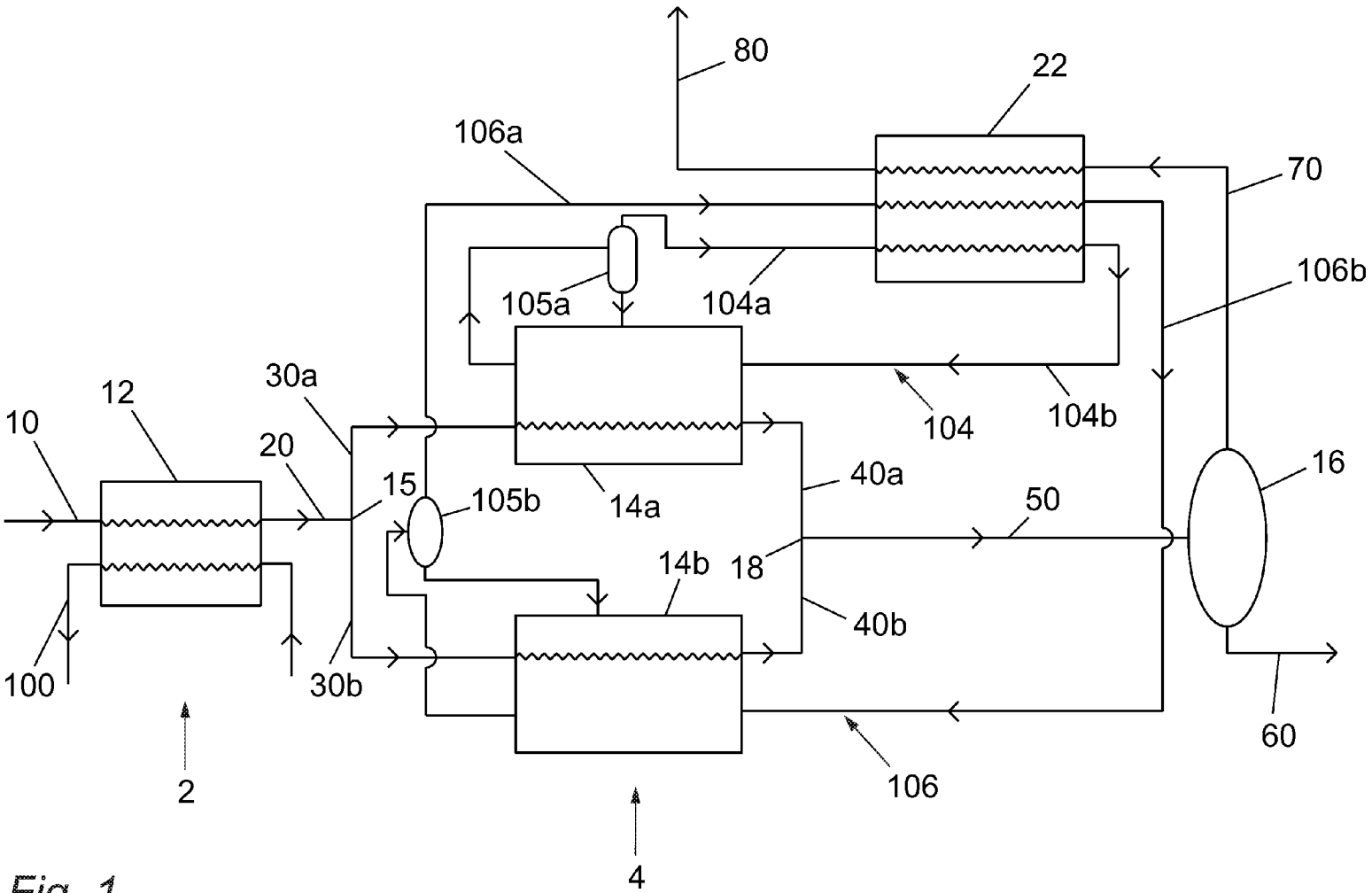
FIG. 1 is a general scheme of part of a liquefaction plant according to one embodiment of the present invention.
Figure 3:
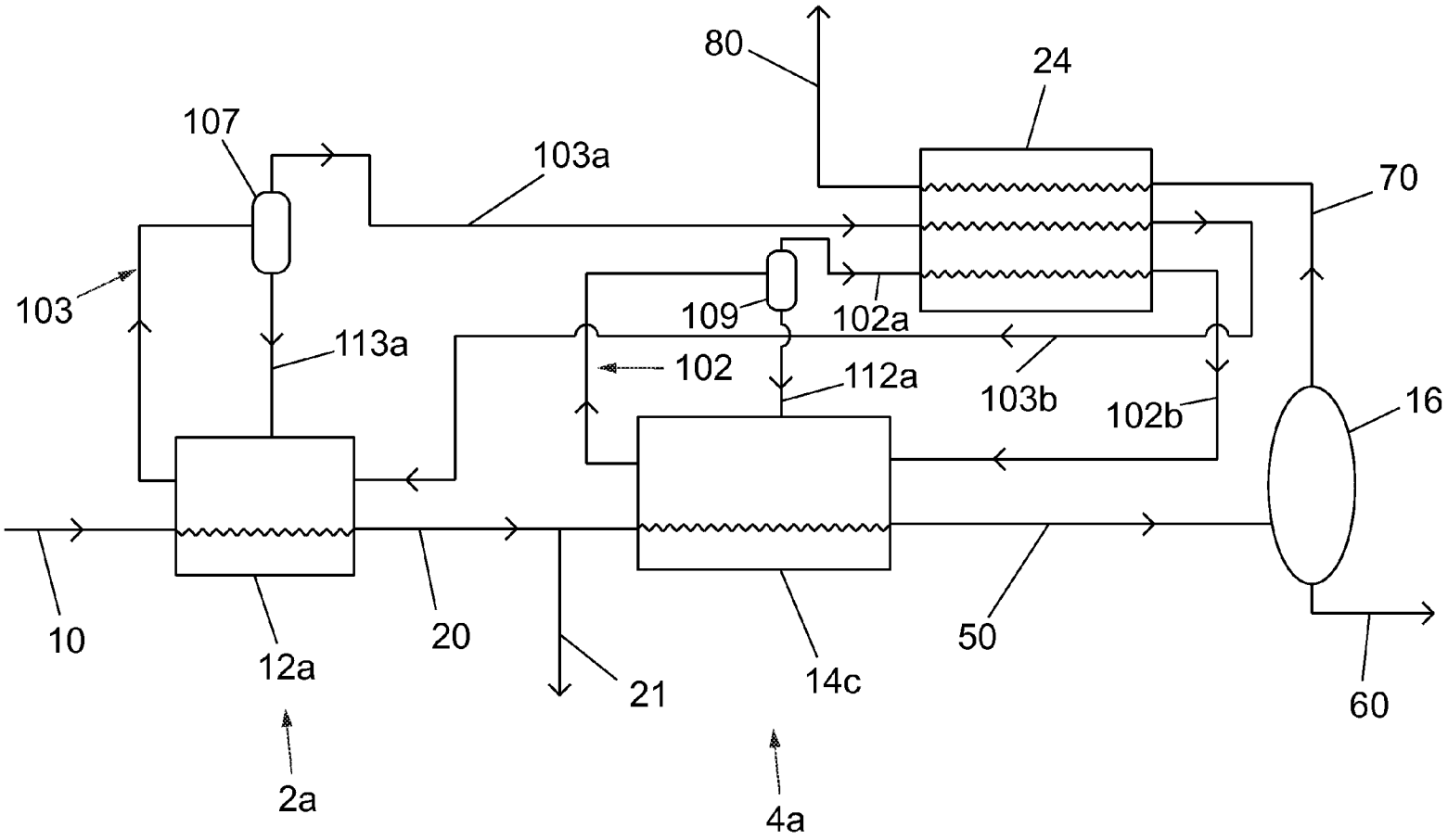
FIG. 3 is a general scheme of part of a liquefaction plant according to a third embodiment of the present invention.

In particular in FIGS. 1 and 3, refrigerant circuits are schematically depicted using a symbol for a heat exchanger and a refrigerant line. Other elements of a refrigerant circuit, such as compressors, ambient coolers, expansion valves, vapour recirculation lines and the like may also be included in accordance with common knowledge in the art, but will for the benefit of clarity not be shown or discussed when referring to these figures. Disclosed herein are methods and apparatuses for liquefying a hydrocarbon stream such as a stream of natural gas. The natural gas, comprising predominantly methane, usually enters an LNG plant at elevated pressures and is pre-treated to produce a purified feed stock suitable for liquefaction at cryogenic temperatures. The purified gas is processed through a plurality of cooling stages using heat exchangers to progressively reduce its temperature until liquefaction is achieved. The liquid natural gas is then further cooled, to reduce flashed vapour generated in one or more expansion stages to final atmospheric pressure suitable for storage and transportation. The flashed vapour from each expansion stage can be used as a source of plant fuel gas.

The cold (energy) of the flashed vapour from an end-flash vessel can be recovered by cooling down at least two light refrigerant streams, or parts thereof, in a heat exchanger, preferably in the form of a countercurrent heat exchanger. This heat exchanger will hereinafter and in the claims be referred to as the "end heat exchanger", to identify it from other heat exchangers used in the processes and apparatuses described herein. In this way, the flashed vapour is brought from a temperature level of about −160° C. to about −40° C., such that the cold of the flashed vapour is recovered prior to it being used as fuel gas.

The methods described herein extend to the gaseous stream providing cooling to two or more streams of any material or substance, including hydrocarbon feed streams, being gaseous, liquid or both, or one or more other streams of gas and/or liquid in a liquefying plant, system or apparatus, alongside the cooling of the two or more light refrigerant streams.

Thus, an advantage of the method described herein is to use the gaseous stream from the end-flash system to provide part cooling, substantially cooling or full cooling to first and second light refrigerant streams.

Further advantageously, the gaseous stream from the end flash vessel can provide direct cooling to multiple light refrigerant lines or a plurality of light refrigerant streams without requiring any intermediate refrigerant processes or streams. It may additionally provide cooling to multiple lines of any line, stream, unit, stage or process (or part or fraction thereof) of a liquefying plant or method. This could include at least some or part liquefying of any feed or cooled hydrocarbon stream. It could also include cooling any combination of first and second light refrigerant stream and feed and/or hydrocarbon streams, or fractions thereof.

Thus, the method described herein can reduce the overall energy requirements of a method or plant or apparatus for liquefying a hydrocarbon stream, and/or make the method, plant or apparatus more efficient and so more economical.

The feed stream is liquefied by passing it through at least two cooling stages. Any number of cooling stages can be used, and each cooling stage involves one or more heat exchangers, as well as optionally one or more steps, levels or sections. Each cooling stage may involve two or more heat exchangers either in series, or in parallel, or a combination of same. Arrangements of suitable heat exchangers able to liquefy a hydrocarbon stream such as natural gas are known in the art.

One arrangement involves the two cooling stages comprising a first cooling stage and a second cooling stage, the first stage being preferably a pre-cooling stage, and the second stage preferably being a main cryogenic stage.

Each cooling stage used in the method described herein may have one or more heat exchangers and one or more refrigerant circuits. Where a cooling stage has more than one heat exchanger, one or more of said multiple heat exchangers may have separate or dedicated refrigerant circuits. At least two of such refrigerant circuits may be separate. Optionally all the refrigerant circuits of a cooling stage, such as a main cryogenic cooling stage, are separate, with preferably a single cryogenic heat exchanger per stream. One or more of the refrigerant circuits may also use, at least in part, cooling from one or more other refrigerant circuits.

In general, one heat exchanger of one of the cooling stages through which the feed stream passes has a first refrigerant circuit, and in the first refrigerant circuit is a first refrigerant, which therefore provides a first refrigerant stream. A second heat exchanger, of the same or of a different cooling stage, has a second refrigerant circuit using a second refrigerant, which thus provides a second refrigerant stream.

The first and second (or any other) refrigerant streams for use in the method described herein may comprise the whole refrigerant stream or a part or fraction thereof.

Preferably, the method described herein further comprises the step (f) of using the warmed exit stream of the gaseous stream from the end heat exchanger as a fuel gas stream. An advantage of this embodiment is that the gaseous stream is still a useable product in an overall plant.

The feed stream may be any suitable hydrocarbon-containing stream to be liquefied, but is usually a natural gas stream obtained from natural gas or petroleum reservoirs. As an alternative the natural gas stream may also be obtained from another source, also including a synthetic source such as a Fischer-Tropsch process.

Usually the natural gas stream is comprised substantially of methane. Preferably the feed stream comprises at least 60 mol % methane, more preferably at least 80 mol % methane.

Depending on the source, the natural gas may contain varying amounts of hydrocarbons heavier than methane such as ethane, propane, butanes and pentanes as well as some aromatic hydrocarbons. The natural gas stream may also contain non-hydrocarbons such as $H_2O$, $N_2$, $CO_2$, $H_2S$ and other sulfur compounds, and the like.

If desired, the feed stream may be pre-treated before using it in the method described herein. This pre-treatment may comprise removal of any undesired components present such as $CO_2$ and $H_2S$, or other steps such as pre-cooling, pre-pressurizing or the like. As these steps are well known to the person skilled in the art, they are not further discussed here.

The end-flash vessel produces a product LNG stream and a gaseous stream.

Although the method described herein is applicable to various hydrocarbon feed streams, it is particularly suitable for natural gas streams to be liquefied. As the person skilled readily understands how to liquefy a hydrocarbon stream, this is not further discussed in detail herein.

Further the person skilled in the art will readily understand that after liquefaction, the liquefied natural gas may be further processed, if desired. As an example, the obtained LNG may be depressurized by means of a Joule-Thomson valve or by means of a cryogenic turbo-expander.

FIG. 1 shows a general arrangement of part of a liquid natural gas (LNG) plant. It shows an initial feed stream containing natural gas 10. In addition to methane, natural gas usually includes some heavier hydrocarbons and impurities, e.g. carbon dioxide, nitrogen, helium, water and non-hydrocarbon acid gases. The feed stream 10 is usually pre-treated to separate out these impurities as far as possible, and to provide a purified feed stock suitable for liquefying at cryogenic temperatures.

In FIG. 1, the feed stream 10 passes through a first cooling stage 2 to provide a cooled stream 20 in the form of a pre-cooled hydrocarbon stream. The first cooling stage 2 is shown symbolically involving one heat exchange step in one heat exchanger 12 with a refrigerant circuit 100, although it may comprise one or more heat exchangers. The first cooling stage 2 will generally cool the feed stream 10 to a temperature below 0° C., and preferably between −20° C. to −50° C.

The pre-cooled hydrocarbon stream 20 is then divided by a stream splitter 15 into two part-streams 30*a*, 30*b*. The cooled stream 20 may be divided into any number of part-streams, and FIG. 1 shows the division into two part-streams 30*a*, 30*b* by way of example only. The division of the cooled stream 20 may be based on any ratio of mass and/or volume and/or flow rate. The ratio may be based on the size or capacity of the subsequent parts of the liquefaction stages or systems or units, or due to other considerations. One example of the ratio is an equal division of cooled stream mass.

In FIG. 1, the part-streams 30*a*, 30*b* pass through a second cooling stage 4, wherein they are liquefied by two separate liquefaction systems, each generally including at least one heat exchanger respectively, to provide separate liquefied part streams 40*a*, 40*b* respectively. Liquefaction systems and process conditions for liquefaction are well known in the art, and are not described further herein. In FIG. 1, the two liquefaction systems are symbolically represented by heat exchangers 14*a* and 14*b*.

Each of the heat exchangers 14*a*, 14*b* in the second cooling stage 4 of the example shown in FIG. 1 uses a refrigerant circuit: the first heat exchanger 14*a* uses a first refrigerant circuit 104, and the second heat exchanger 14*b* uses a second refrigerant circuit 106. Each of these refrigerant circuits 104, 106 can use the same or different refrigerants. Preferably, each uses the same refrigerant. The refrigerant for each of the refrigerant circuits 104, 106 is a mixed refrigerant. The mixed refrigerant may be based on two or more components, preferably selected from the group comprising nitrogen, methane, ethane, ethylene, propane, propylene, butane and pentane.

Generally, the cooled stream 20, or the part-streams 30*a*, 30*b*, are cooled by the second cooling stage 4 to a temperature of at least below −100° C.

In one example, the scheme shown in FIG. 1 is a dual heat exchanger, dual refrigerant system, with the first cooling stage 2 serving two main, preferably cryogenic, refrigeration systems. Consequently, the depth to which the feed stream 10, which is preferably natural gas, is first-cooled may be reduced. Moreover, the conditions of the first cooling stage 2 and for the liquefactions in the second stage 4, for example the compositions of the refrigerants, can easily be adapted such that an efficient operation is achieved. Further, in case one of the main liquefying systems or one of its operations has to be reduced or taken out of operation, the conditions can be adapted to work efficiently with a single main liquefaction system. In this way, the liquefaction capacity can be increased without having to add a second first cooling stage, and this saves substantial costs. An example of a pre-cooled, dual heat exchanger, dual refrigerant system is shown in U.S. Pat. No. 6,389,844 B1.

The arrangement in FIG. 1 has the further advantage of carrying out certain operations in a combined manner to reduce capital and running costs, compared with the need for carrying out each operation individually, i.e. needing separate and duplicated liquefaction systems, sometimes also termed 'trains'.

The liquefied part streams 40*a* and 40*b* are then combined. They may be combined in any known manner, and in any known combination of steps. Such combination of streams may be prior to or after any expansion of any of the liquefied part streams 40*a*, 40*b*. The combining of the liquefied streams may not require full integration or mixing for their subsequent passage through a gas/liquid separator 16. Preferably the streams are combined before passing through an end-flash vessel or other gas/liquid separator. Arrangements required for the combining are known to the person skilled in the art.

The example arrangement shown in FIG. 1 is for the combination of the liquefied part streams 40*a*, 40*b* using a combiner 18 known in the art, to provide a combined liquefied hydrocarbon stream 50. The combiner may be any suitable arrangement, generally involving a union or junction or piping or conduits, optionally involving one or more valves.

The combined liquefied hydrocarbon stream 50 provided by the second cooling stage 4 can pass through a flash valve (not shown) and then on to the gas/liquid separator 16, wherein the liquid stream is generally recovered as a liquefied hydrocarbon product stream 60, and the vapour is provided as a gaseous stream 70. The liquefied hydrocarbon stream 60 is then sent by one or more pumps (not shown) to storage and/or transportation facilities.

The gas/liquid separator 16 may be an end-flash vessel or any other suitable separator type for the purpose of end-flash vapour separation including a suitable type of separator column.

The resultant gaseous stream 70 from the gas/liquid separator 16 is passed through a heat exchanger 22, which heat exchanger may hereinafter be referred to as the "end heat exchanger" to identify it from other heat exchangers in the process. In the end heat exchanger 22, it is possible to use the cold energy of the gaseous stream 70 against two or more light refrigerant streams, such as the first and second light refrigerant streams 104*a*, 106*a* of the first and second refrigerant circuits 104, 106 shown in FIG. 1. The first and second light refrigerant streams 104*a*, 106*a* pass, usually in counter current, though the end heat exchanger 22. The exit stream 80 of the gaseous stream 70 from the end heat exchanger 22 can then be used as a fuel gas and/or used in other parts of the LNG plant.

Coming from the end separation of a liquefied hydrocarbon process, such as LNG production, the gaseous stream 70 (which stream may also be termed a fuel gas stream) generally has a temperature between −150° C. and −170° C., usually about −160° C. to −162° C.

The cooling provided by the gaseous stream 70 may not involve completely cooling a stream to the temperature of the gaseous stream 70 as it enters the end heat exchanger 22. It is possible for the gaseous stream 70 to provide cooling to any suitable temperature, and such cooling can be the same or different to each stream being cooled in the end heat exchanger 22.

In one example, it is possible to use the cooling of the gaseous stream 70 to effect cooling against additional suitable streams whose exit temperature from the end heat exchanger 22 is intended to be any temperature down to the incoming temperature of the gaseous stream 70, such as −150° C. or −160° C.

In FIG. 1, the gaseous stream 70 provides cooling to the first and second light refrigerant streams 104*a*, 106*a*, to provide cooled and preferably condensing first and second cooled refrigerant streams 104*b*, 106*b* respectively, for use in the first and second heat exchangers 14*a*, 14*b* of the second cooling stage 4.

Each of the first and second refrigerant circuits 104, 106 in FIG. 1 may include a gas/liquid separator 105*a, b*, such that the refrigerant is divided for use into a light refrigerant fraction and a heavier refrigerant fraction. It is the light refrigerant fraction of each refrigerant circuit that is used as the first and second light refrigerant streams 104*a*, 106*a* that are passed into the end heat exchanger 22 through which the gaseous stream 70 also passes to provide cooling thereto.

An advantage of the example shown in FIG. 1 is that by using a common end-flash cooling for the liquefied hydrocarbon stream 50, a single gaseous stream 70 is able to provide cooling, i.e. its cold energy is recoverable, against two or more light refrigerant streams. This avoids splitting any single low-pressure end flash gas flow to feed separate cold recovery exchanges at the end of separate liquefaction systems. This also reduces the number of cold recovery exchanges from, for example, 2 to 1, for multiple liquefaction systems, resulting in clear capital and running cost reductions. Further, any additional pressure drop induced by flow balancing across the two exchanges between the source of end flash gas and the end flash compressor suction is avoided.

Further, the arrangement of the example shown in FIG. 1 could involve the full recovery of the cold energy of the gaseous stream 70 against the first and second light refrigerant streams 104*a*, 106*a* passing through the end heat exchanger 22, as it is usually desired for the refrigerant streams for main cryogenic heat exchange to be at low temperatures, such as those between −150° C. and −170° C.

Figure 2:
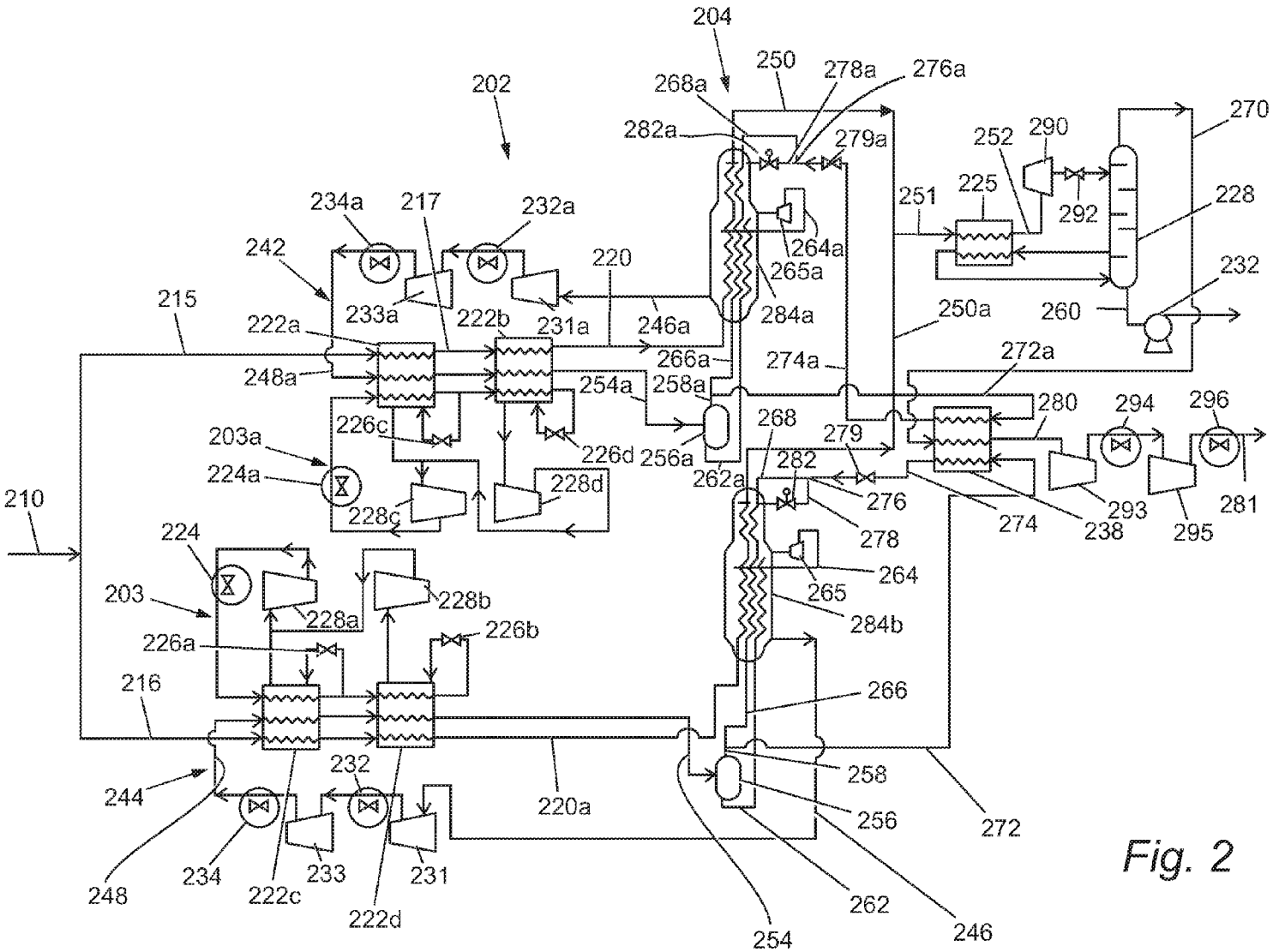
FIG. 2 is a more detailed scheme of a liquefaction plant according to a second embodiment of the present invention.

FIG. 2 shows a more detailed scheme for a second embodiment as described herein, wherein a feed stream 210 similar to the feed stream 10 used in FIG. 1 is divided into two part-feed streams 215, 216, which pass through two separate, parallel, sets of first heat exchangers, 222*a*, 222*b*, and 222*c*, 222*d*, as the first cooling stage 202. Each set of heat exchangers has a separate refrigerant circuit 203, 203*a*. The first heat exchangers 222*a*, 222*b*, 222*c*, 222*d*, and/or the refrigerant circuits 203, 203*a* used in these heat exchangers, may be the same or different.

Between the first set of first heat exchangers 222*a*, 222*b* cooling the first part-feed stream 215, there is a first cooled stream 217. After the second heat exchanger 222*b*, there is a pre-cooled hydrocarbon stream 220. This stream 220, and the equivalent pre-cooled hydrocarbon stream 220*a* from the second set of first heat exchangers 222*c*, 222*d* of the first cooling stage 202, then pass into two parallel second heat exchangers 284*a*, 284*b*, which form the second cooling stage 204.

For clarity, first cooling stage 202 and refrigerant circuit 203 will now be described in more detail, with the corresponding features of parallel refrigerant circuit 203*a* shown in parenthesis. The part-feed stream 216 (215) is cooled in heat exchangers 222*c*, 222*d* (222*a*, 222*b*) against a first refrigerant stream, which has been cooled by cooler 224 (224*a*), preferably cooled against ambient in an ambient cooler, to form a cooled refrigerant stream. This cooled refrigerant stream passes through heat exchanger 222*c* (222*a*). Upon exiting the heat exchanger, the refrigerant stream is split, into a first split refrigerant stream and a second split refrigerant stream.

The first split refrigerant stream is fed to expansion valve 226*a* (226*c*) and passed to the shell-side of heat exchanger 222*c* (222*a*). Upon exiting heat exchanger 222*c* (222*a*), the first split refrigerant stream is combined with the second split refrigerant stream from compressor 228*b* (228*d*) discussed below, to form a combined refrigerant stream and passed to compressor 228*a* (228*c*). The combined refrigerant stream exiting compressor 228*a* (228*c*) is then passed to cooler 224 (224*a*).

The second split refrigerant stream is passed through heat exchanger 222*d* (222*b*), fed to expansion valve 226*b* (226*d*) and passed to the shell-side of heat exchanger 222*d* (222*b*). Upon exiting heat exchanger 222*d* (222*b*) the second split refrigerant stream is then passed to compressor 228*b* (228*d*), before being combined with the first split refrigerant stream exiting heat exchanger 222*c* (222*a*).

The second heat exchangers 284*a*, 284*b*, of the second cooling stage 204 are preferably spool-wound or spiral-wound cryogenic heat exchangers, whose operation is known in the art. Each of these second heat exchangers 284*a*, 284*b* provides a liquefied hydrocarbon part-stream 250, 250*a*, which part-streams 250, 250*a* are then combined into a combined liquefied hydrocarbon stream 251. After passage through a third heat exchanger 225, yielding a cooled combined liquefied hydrocarbon stream 252, the cooled combined liquefied hydrocarbon stream 252 passes through an end-flash system comprising an expander 290, then an optional expansion valve 292, and then into a gas/liquid separator 228 of any type known in the art, such as an end flash vessel. From the end flash vessel 228 there is provided a liquefied hydrocarbon product stream 260, which can then be passed along by a pump 232 to storage and/or transportation.

The end flash vessel 228 also provides a gaseous stream 270, comprising flashed vapour, which passes into an end heat exchanger 238. After passage through the end heat exchanger 238 against two refrigerant streams as described hereinafter, the exit stream 280 may be passed through one or more compressors 293, 295 and one or more coolers 294, 296, typically ambient coolers, (FIG. 2 exemplifies two of each) to provide a final fuel gas stream 281.

In the second cooling stage 204, each second heat exchanger 284*a*, 284*b* involves a separate refrigerant circuit, hereinafter termed a first refrigerant circuit 242 serving the second heat exchanger 284*a*, and a second refrigerant circuit 244 serving the second heat exchanger 284*b*.

In the second cooling stage 204, the second heat exchangers 284*a*, 284*b*, and/or the first and second refrigerant circuits 242, 244, may be the same or different. The heat exchangers of the second cooling stage may be adapted to accommodate the heat exchangers of the first cooling stage, especially where the part feed-streams and/or subsequent cooled hydrocarbon streams are different in any way, such as mass, flow, volume and/or composition.

In one embodiment described herein, the second heat exchangers 284*a*, 284*b* of the second cooling stage 204 are the same or similar, and the first and second refrigeration circuits 242, 244 are the same or similar.

In the example shown in FIG. 2, the first and second refrigerant circuits 242, 244 use a mixed refrigerant, preferably the same mixed refrigerant. The mixed refrigerant may be based on two or more components, more preferably selected from the group comprising nitrogen, methane, ethane, ethylene, propane, propylene, butane and pentane.

For clarity, the second refrigerant circuit 244 will now be described in more detail, with the corresponding features of first refrigerant circuit 242 shown in parenthesis. From the heat exchanger 284*b* (284*a*), a stream of vapourised refrigerant 246 (246*a*) is provided, and compressed and cooled by two compressors 231, 233 (231*a*, 233*a*) and two ambient coolers, typically in the form of water or air coolers 232, 234 (232*a*, 234*a*), to provide a cooled refrigerant stream 248 (248*a*). This cooled refrigerant stream 248 (248*a*) then passes through the set of two heat exchangers 222*c*, 222*d* (222*a*, 222*b*) of one part of the first cooling stage 202, which provides some cooling to the second refrigerant. This further cooled refrigerant stream 254 (254*a*) is then passed into second respectively first gas/liquid separators 256, 256*a*.

The separator 256 (256*a*) provides a second light refrigerant stream 258 (first light refrigerant stream 258*a*, respectively), and a second heavy refrigerant stream 262 (first heavy refrigerant stream 262*a*, respectively). The heavy refrigerant stream 262 (262*a*) passes into the heat exchanger 284*b* to be expanded in expander 265 (265*a*) to provide an expanded and cooled heavy refrigerant stream 264 (264*a*), prior to use of its cold energy in the heat exchanger 284*b* (284*a*) in a manner known in the art.

The light refrigerant stream 258 (258*a*) is divided into two further refrigerant fractions, hereinafter termed first and second light fractions 266 (266*a*) and 272 (272*a*). The first light fraction 266 (266*a*) passes into the heat exchanger 284*b* for cooling and outflow as a first cooled light fraction 268 (268*a*).

Meanwhile, the second light fraction 272 (272*a*), being a part of the first light refrigerant stream 258, passes into the end heat exchanger 238 and is passed therethrough in counter current with respect to the flow of the gaseous stream 270 from the end flash vessel 228. Also passing through the end heat exchanger 238 is a similar second light fraction 272*a* of first light refrigerant stream 258*a* flowing in the first refrigerant circuit 242, (which fraction 272*a* is provided in the same or a similar manner to that of the second light fraction 272).

As these streams of light refrigerant fractions 272, 272*a* pass through the end heat exchanger 238, they are cooled as separate streams against the gaseous stream 270. The separate cooled light refrigerant fractions 274, 274*a* exiting the end heat exchanger 238 are preferably of the same or a similar temperature, for example a temperature difference of <10° C., to the first light refrigerant fractions 268, 268*a* that have passed through and been cooled by the heat exchangers 284*a*, 284*b*. The first and separately cooled light fractions 268 and 274 (and 268*a* and 274*a*) can then be combined (for example, by a combiner 276(276*a*)) to form a combined light refrigerant stream 278 (278*a*), which can be expanded in valve 282 (282*a*), prior to re-introduction into the heat exchanger 284*b* (284*a*) to provide cooling to the lines of hydrocarbon and refrigerant passing therethrough.

The combination of the streams 268 and 274 (268*a* and 274*a*) can occur before, during, or after any expansion of the individual or combined streams prior to their re-introduction into the heat exchangers 284*a*, 284*b*. In the scheme shown in FIG. 2, separate cooled light refrigerant fractions 274 (274*a*) are passed through expansion valves 279 (279*a*) prior to combining with the first cooled light fractions 268 (268*a*).

The advantages described herein in relation to the example shown in FIG. 1 apply equally to the example of FIG. 2.

Table 1 gives a representative working example of temperatures, pressures and flows of streams at various parts an example process as described herein referring to FIG. 2.

TABLE 1

| Stream Number | Temperature (° C.) | Pressure (bar) | Mass flow (kg/s) | Phase |
|---|---|---|---|---|
| 210 | 50.0 | 92.6 | 280.0 | Vapor |
| 215 | 50.0 | 92.6 | 140.0 | Vapor |
| 217 | −4.5 | 90.8 | 140.0 | Vapor |
| 220 | −41.5 | 89.0 | 140.0 | Vapor |
| 250 | −151.4 | 83.5 | 140.0 | Liquid |
| 251 | −151.4 | 83.5 | 280.0 | Liquid |
| 252 | −156.8 | 81.0 | 280.0 | Liquid |
| 260 | −162.5 | 1.1 | 251.6 | Liquid |
| 270 | −165.1 | 1.0 | 28.4 | Vapor |
| 280 | −44.5 | 0.9 | 28.4 | Vapor |
| 281 | 51.0 | 28.6 | 28.4 | Vapor |
| 246 | −43.7 | 4.0 | 205.0 | Vapor |
| 248 | 46.0 | 53.3 | 205.0 | Vapor |
| 254 | −41.5 | 49.0 | 205.0 | Mixed |
| 262 | −41.6 | 48.9 | 169.0 | Liquid |
| 258 | −41.6 | 48.9 | 36.0 | Vapor |
| 272 | −41.6 | 48.9 | 5.1 | Vapor |
| 266 | −41.6 | 48.9 | 30.9 | Vapor |
| 264 | −135.1 | 4.4 | 169.0 | Mixed |
| 268 | −151.42 | 42.8 | 30.9 | Liquid |
| 274 | −162.1 | 48.4 | 5.1 | Liquid |
| 278 | −157.5 | 4.5 | 36.0 | Mixed |

FIG. 3 shows a general scheme for another LNG plant incorporating another embodiment of the invention. In FIG. 3, the initial feed stream 10 passes through a first cooling stage 2*a* shown symbolically as a heat exchanger 12*a* having a first refrigerant circuit 103, to provide a cooled stream 20 in the form of a pre-cooled hydrocarbon stream as hereinbefore described. In this embodiment the first refrigerant circuit and the first light refrigerant stream of which at least part is cooled against the gaseous stream ex end flash system are provided in the first cooling stage, while the second refrigerant circuit using the second light refrigerant steam of which at least part is cooled against the gaseous stream ex end flash system is provided in the second cooling stage. In more detail, the refrigerant of the first refrigerant circuit 103 is a mixed refrigerant as herein defined. The first refrigerant circuit 103 provides a first light refrigerant stream 103*a*. The first refrigerant circuit 103 includes a gas/liquid separator 107 in order to create a first light refrigerant stream 103*a* and a heavy refrigerant stream 113*a*. The cooled stream 20 from the first cooling stage 2*a* is passed to a second cooling stage 4*a* to provide a liquefied hydrocarbon stream 50.

Optionally, a fraction of the cooled stream 20 could be divided therefrom (for example as stream 21) so as to be separately liquefied by another, parallel, heat exchanger of the second cooling stage 4*a*.

The second cooling stage 4*a* is shown symbolically in FIG. 3 as involving a heat exchanger 14*c* and a second refrigerant circuit 102. The second refrigerant for the second refrigerant circuit 102 is a mixed refrigerant comprising two or more components, more preferably two or more components selected from the group comprising nitrogen, methane, ethane, ethylene, propane, propylene, butane and pentane. The second refrigerant circuit 102 provides a second light refrigerant stream 102*a*.

The second refrigerant circuit 102 in FIG. 3 includes a gas/liquid separator 109 to separate the mixed refrigerant into the second light refrigerant stream 102*a* and a second heavy refrigerant stream 112*a*.

The second cooling stage 4*a* could comprise more than one heat exchanger to cool the stream 20. Cooling of the stream 20 may also be assisted by one or more other heat exchangers or coolers or refrigerants (not shown in FIG. 3), either related to and/or unrelated to the scheme of the LNG plant shown in FIG. 3.

Similar to the example in FIG. 1 described above, the liquefied hydrocarbon stream 50 provided by the second cooling stage 4*a* can pass through a flash valve (not shown) and then on to gas/liquid separator 16, which may be an end flash vessel, wherein the liquid stream is generally recovered as a liquefied hydrocarbon product stream 60, and the vapour is provided as a gaseous stream 70. The liquefied hydrocarbon stream 60 may then be sent by one or more pumps (not shown) to storage and/or transportation facilities.

The resultant gaseous stream 70 from the end flash vessel 16 is passed through an end heat exchanger 24. In the end heat exchanger 24, it is possible to use the cold energy of the gaseous stream 70 against the first and second light refrigerant streams 103*a*, 102*a* of the first and second refrigerant circuits 103, 102. The first and second light refrigerant streams 103*a*, 102*a* pass, usually countercurrently, through the end heat exchanger 24. The exit stream 80 of the gaseous stream 70 from the end heat exchanger 24 can then be used as a fuel gas and/or used in other parts of the LNG plant. The cooled first and second refrigerant streams 103*b*, 102*b* return to the heat exchangers 12*a*, 14*c*.

The person skilled in the art will understand that the present invention can be carried out in many various ways without departing from the scope of the appended claims.

What is claimed is:

1. A method of liquefying a hydrocarbon stream from a feed stream, the method at least comprising the steps of:

(a) providing a feed stream;

(b) passing the feed stream through at least two cooling stages to provide a liquefied hydrocarbon stream, each cooling stage involving one or more heat exchangers, one of said heat exchangers involving a first refrigerant circuit having a first refrigerant stream of a first mixed refrigerant, and a second of said heat exchangers involving a second refrigerant circuit having a second refrigerant stream of a second mixed refrigerant;

(c) separating the first refrigerant stream into a first light refrigerant stream and a first heavy refrigerant stream, and separating the second refrigerant into a second light refrigerant stream and a second heavy refrigerant stream;

(d) expanding the liquefied hydrocarbon stream and separating flashed vapour from the liquefied hydrocarbon stream to provide a liquefied hydrocarbon product stream and a gaseous stream; and (e) passing the gaseous stream, the first light refrigerant stream and the second light refrigerant stream through an end heat exchanger, for the gaseous stream to provide cooling to the first and second light refrigerant streams.

2. A method as claimed in claim 1, wherein expanding the liquefied hydrocarbon stream, in step (d) comprises passing the liquefied hydrocarbon stream through one or more expansion stages.

3. A method as claimed in claim 1, wherein the at least two cooling stages comprise a first cooling stage in the form of a pre-cooling stage followed by a second cooling stage in the form of a main cryogenic cooling stage.

4. A method as claimed in claim 3, wherein the first cooling stage comprises two or more serial heat exchange steps.

5. A method as claimed in claim 3, wherein the second cooling stage comprises two or more parallel heat exchange steps.

6. A method as claimed in claim 5, wherein at least two of the heat exchangers of the second cooling stage involve separate refrigerant circuits, and at least part of the refrigerants of these separate refrigerant circuits provide the first and second light refrigerant streams of step (c).

7. A method as claimed in claim 5, wherein the first cooling stage provides a pre-cooled hydrocarbon stream, which is divided between two or more part streams, and each part stream is separately liquefied in one or more cryogenic heat exchangers of the second cooling stage, each cryogenic heat exchanger providing a liquefied hydrocarbon part stream, which liquefied hydrocarbon part streams are combined to provide the liquefied hydrocarbon stream of step (b).

8. A method as claimed in claim 1, wherein the mixed refrigerants of the first and second refrigerant circuits independently comprise two or more components selected from the group comprising nitrogen, methane, ethane, ethylene, propane, propylene, butane and pentane.

9. A method as claimed in claim 1 wherein the gaseous stream exits the end heat exchanger as a warmed gaseous stream, and further comprising a step (f) using the warmed gaseous stream exiting from the end heat exchanger as a fuel gas stream.

10. Apparatus for liquefying a hydrocarbon stream from a feed stream, the apparatus at least comprising:

two cooling stages to provide a liquefied hydrocarbon stream from the feed stream, each cooling stage involving one or more heat exchangers, one of said heat exchangers involving a first refrigerant circuit having a first refrigerant stream of first mixed refrigerant, and a second of said heat exchangers involving a second refrigerant circuit having a second refrigerant stream of a second mixed refrigerant;

a first separator in the first refrigerant circuit to separate the first mixed refrigerant stream into a first light refrigerant stream and a first heavy refrigerant stream and a second separator in the second refrigerant circuit to separate the second mixed refrigerant stream into a second light refrigerant stream and a second heavy refrigerant stream;

an end-flash system comprising a gas/liquid separator to receive the liquefied hydrocarbon stream and to provide a liquefied hydrocarbon product stream and a gaseous stream; and an end heat exchanger arranged to receive the gaseous stream, the first light refrigerant stream and the second light refrigerant stream, and to allow the gaseous stream to provide cooling to the first and second light refrigerant streams.

11. The apparatus as claimed in claim 10, wherein the end-flash system further comprises an expansion means.

12. A method as claimed in claim 2, wherein the at least two cooling stages comprise a first cooling stage in the form of a pre-cooling stage followed by a second cooling stage in the form of a main cryogenic cooling stage.

13. A method as claimed in claim 12, wherein the first cooling stage comprises two or more serial heat exchange steps.

14. A method as claimed in claim 4, wherein the second cooling stage comprises two or more parallel heat exchange steps.

15. A method as claimed in claim 12, wherein the second cooling stage comprises two or more parallel heat exchange steps.

16. A method as claimed in claim 13, wherein the second cooling stage comprises two or more parallel heat exchange steps.

17. A method as claimed in claim 14, wherein at least two of the heat exchangers of the second cooling stage involve separate refrigerant circuits, and at least part of the refrigerants of these separate refrigerant circuits provide the first and second light refrigerant streams of step (c).

18. A method as claimed in claim 15, wherein at least two of the heat exchangers of the second cooling stage involve separate refrigerant circuits, and at least part of the refrigerants of these separate refrigerant circuits provide the first and second light refrigerant streams of step (c).

19. A method as claimed in claim 16, wherein at least two of the heat exchangers of the second cooling stage involve separate refrigerant circuits, and at least part of the refrigerants of these separate refrigerant circuits provide the first and second light refrigerant streams of step (c).

20. A method as claimed in claim 6, wherein the first cooling stage provides a pre-cooled hydrocarbon stream, which is divided between two or more part streams, and each part stream is separately liquefied in one or more cryogenic heat exchangers of the second cooling stage, each cryogenic heat exchanger providing a liquefied hydrocarbon part stream, which liquefied hydrocarbon part streams are combined to provide the liquefied hydrocarbon stream of step (b).

* * * * *